US005675311A

United States Patent [19]

Burnett et al.

[11] Patent Number: 5,675,311

[45] Date of Patent: Oct. 7, 1997

[54] FREQUENCY SWEEPING AUDIO SIGNAL DEVICE

[75] Inventors: George Alan Burnett, Hendricks County; Robert Lyle Leonard, Jr., Marion County, both of Ind.

[73] Assignee: Yosemite Investment, Inc., Indianapolis, Ind.

[21] Appl. No.: 458,333

[22] Filed: Jun. 2, 1995

[51] Int. Cl.[6] ..... G08B 3/00

[52] U.S. Cl. ..... 340/384.4; 340/384.71; 340/384.72; 340/382.1; 116/147

[58] Field of Search ..... 340/384.4, 384.71, 340/384.72, 392.1, 384.5; 116/147

[56] References Cited

U.S. PATENT DOCUMENTS

| | | | |
|---|---|---|---|
| 3,981,007 | 9/1976 | Cieslak et al. | 340/384.4 |
| 4,075,624 | 2/1978 | Sheff | 340/384.4 |
| 4,078,209 | 3/1978 | Paladino | 340/384.4 |
| 4,086,589 | 4/1978 | Cieslak et al. | 340/384.4 |
| 4,189,718 | 2/1980 | Carson et al. | 340/384.4 |
| 4,206,448 | 6/1980 | Davis | 340/384 E |
| 4,213,121 | 7/1980 | Learn et al. | 340/384 E |
| 4,389,638 | 6/1983 | Gontowski et al. | 340/384.4 |
| 4,646,063 | 2/1987 | Carson | 340/384.4 |
| 4,980,837 | 12/1990 | Nunn et al. | 364/484 |

OTHER PUBLICATIONS

"Encyclopedia of Electronic Circuits—vol. 2", Rudolf F. Graf, TAB Books, 1988, p. 522. 1988.

"Encyclopedia of Electronic Circuits—vol. 4", Rudolf F. Graf and William Sheets, TAB Books, 1992, p. 421. 1992.

Howard W. Sams & Co., Inc., *Reference Data For Radio Engineers* Fifth Edition, 1973, p. 19–18.

*Primary Examiner*—Jeffery Hofsass
*Assistant Examiner*—Daniel J. Wu
*Attorney, Agent, or Firm*—Niro, Scavone, Haller & Niro

[57] ABSTRACT

An audio signal is generated that sweeps from a lower frequency to a higher frequency in a substantially linear function. The circuit used to produce this sweeping audio frequency has a stable power supply, a square wave oscillator, a ramp generator, a voltage controlled oscillator, a drive circuit and an audio circuit. The square wave generator is composed of logic gates that generate a square wave with near instantaneous rising and falling edges. The ramp generator creates a sweep drive signal that is a substantially linear triangular waveform.

13 Claims, 5 Drawing Sheets

FREQUENCY SWEEPING AUDIO SIGNAL DEVICE

BACKGROUND

The invention relates to a signalling means for producing an acoustic wave as a signalling indication. More specifically, this invention uses electronic circuitry with a signal generator to create an audio frequency electrical signal that has a rising and falling pitch and a piezoelectric transducer to convert this signal into audible sounds.

Frequency sweeping audio devices have been used for many years to generate a signal that resembles a rising and falling pitch or tone. Some describe this rising and falling tone as yelping or whooping sounds. An audio frequency generator of this type can be used to produce a signal such as an alarm or warning signal.

One technique in the art for generating a rising and falling pitch is to drive a voltage controlled oscillator with a periodic ramp voltage from a ramp generator circuit. The periodic ramp voltage typically resembles a curved triangular waveform with an arching ascending ramp and an arching descending ramp. A problem with using a curved triangular waveform to drive a voltage controlled oscillator is that the curved triangular waveform causes the output frequency to rise and fall in a nonlinear fashion. Some persons interpret an output frequency that rises and falls in a nonlinear fashion as producing a low quality sound. An example of this technique is disclosed in U.S. Pat. No. 4,206,448 issued to Davis.

Previous audio frequency sweeping devices operate over a relatively narrow input voltage range. Input voltage variations can cause the output frequency sweeping audio signal to rise and fall in a nonlinear fashion. Additionally, a variety of power supply designs can be required for the frequency sweeping audio device to operate in a range of voltage such as from 10–48 VDC. The use of a variety of power supply designs can decrease the versatility of a frequency sweeping audio device and can increase cost because larger inventories may be required.

What is needed is a frequency sweeping output tone that rises and falls in a substantially linear fashion that can operate under a wide ranging input voltage.

SUMMARY

It is an object of the invention to create an audio signal that has a substantially linear sweep from a rising pitch to a falling pitch and back to a rising pitch.

It is another object of the invention to create an audio signal that has a substantially constant lower and upper frequency limit.

It is yet another object of the invention to create an audio signal that has a substantially constant audio output amplitude.

It is still another object of the invention to operate over a wide range of input voltages with a substantially linear sweep from a rising pitch to a falling pitch and back to a rising pitch despite input voltage variations.

It is yet another object of the invention to operate over a wide range of input voltages to increase the range of applications in which the invention can be used.

We have invented a frequency sweeping audio signalling device that sweeps from a lower frequency to a higher frequency and back to a lower frequency in a substantially linear function. The frequency sweeping audio signalling device has a voltage regulator, a square wave oscillator, a ramp generator, a voltage controlled oscillator, a driver circuit, and an audio generation circuit.

The voltage regulator provides a stable voltage source to the frequency sweeping audio signalling device. The square wave oscillator circuit is connected to the stable voltage source and generates a sweep rate signal. The ramp generator circuit receives the sweep rate signal from the square wave oscillator and generates a sweep drive signal that is a substantially linear triangular waveform. The voltage controlled oscillator circuit receives the sweep rate signal from the ramp generator and generates a frequency sweep signal that makes an excursion rising in frequency and then falling in frequency in a substantially linear sweep. The drive circuit receives the frequency sweep signal and generates a drive output signal that has a higher amplitude than the frequency sweep signal. Finally the audio circuit receives the drive output signal and generates an audio frequency that sweeps from a lower frequency to a higher frequency and back to a lower frequency in a substantially linear function.

DETAILED DESCRIPTION

Figure 1:
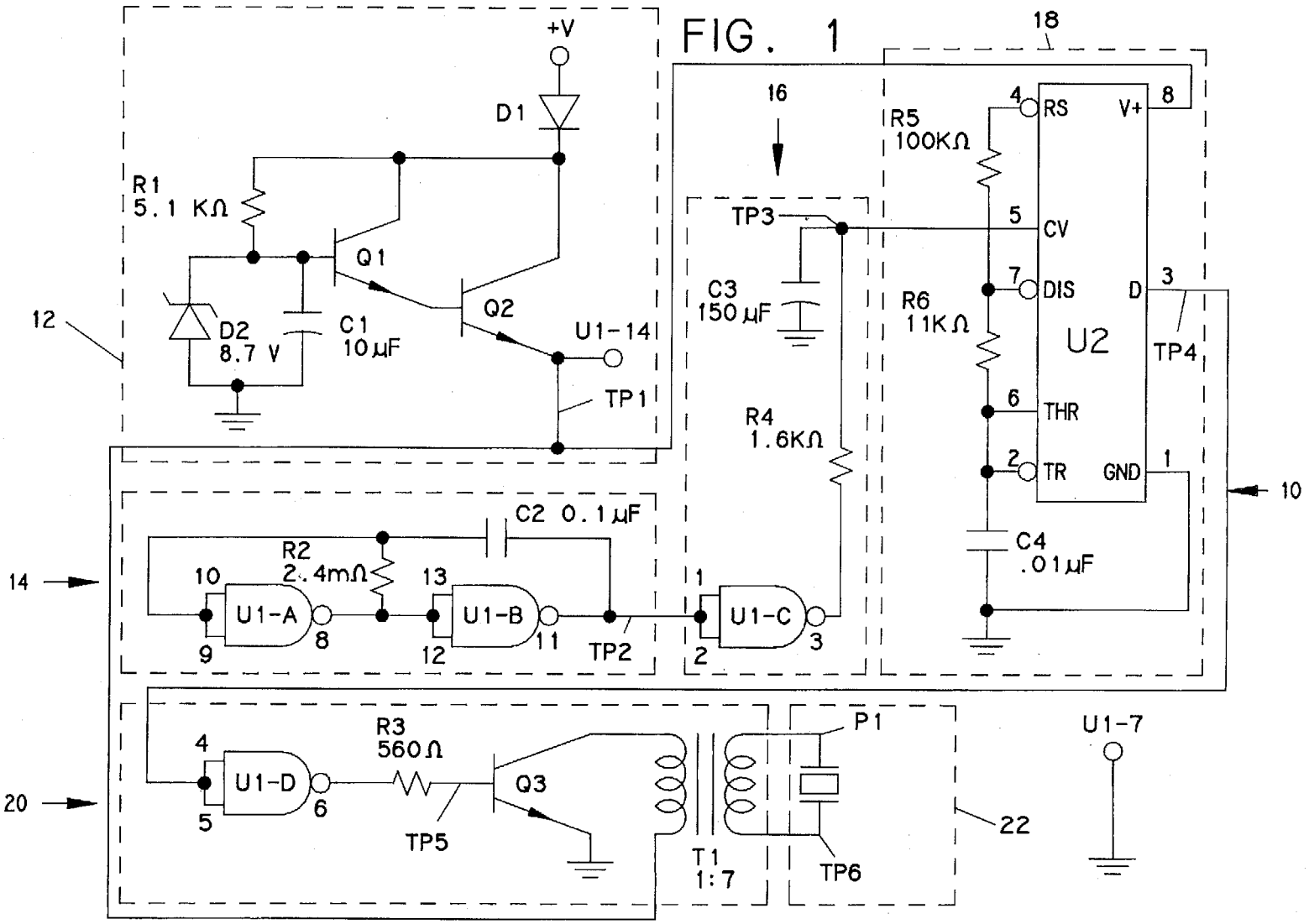
FIG. 1 shows a schematic diagram of a frequency sweeping audio device circuit.

Referring to FIG. 1, a frequency sweeping audio signaling device 10 comprises a voltage regulator 12, a square wave oscillator 14, a ramp generator 16, a voltage controlled oscillator 18, a drive circuit 20, and an audio generator 22.

The voltage regulator 12 comprises diode D1, resistor R1, Zener diode D2, capacitor C1, and transistors Q1 and Q2. Diode D1 protects the frequency sweeping audio signaling device 10 from damage caused by application of a reverse polarity voltage. Resistor R1 provides the proper amount of current and voltage to keep Zener diode D2 in the Zener region, and resistor R1 protects diode D2 by limiting current at higher input voltage levels. Zener diode D2 provides a near constant voltage level of 8.7 volts at the base of transistor Q1. Capacitor C1 filters out transients and smooths AC power ripple. Transistors Q1 and Q2 are NPN transistors configured as a Darlington pair. It is a feature of this invention that the Darlington transistor pair provides better voltage regulation than use of a single transistor. The increase current gain of the Darlington pair over the use of a single transistor provides greater sensitivity to changes in load conditions to the voltage regulator. This increased sensitivity causes the output voltage of the voltage regulator to be more constant.

Figure 2:
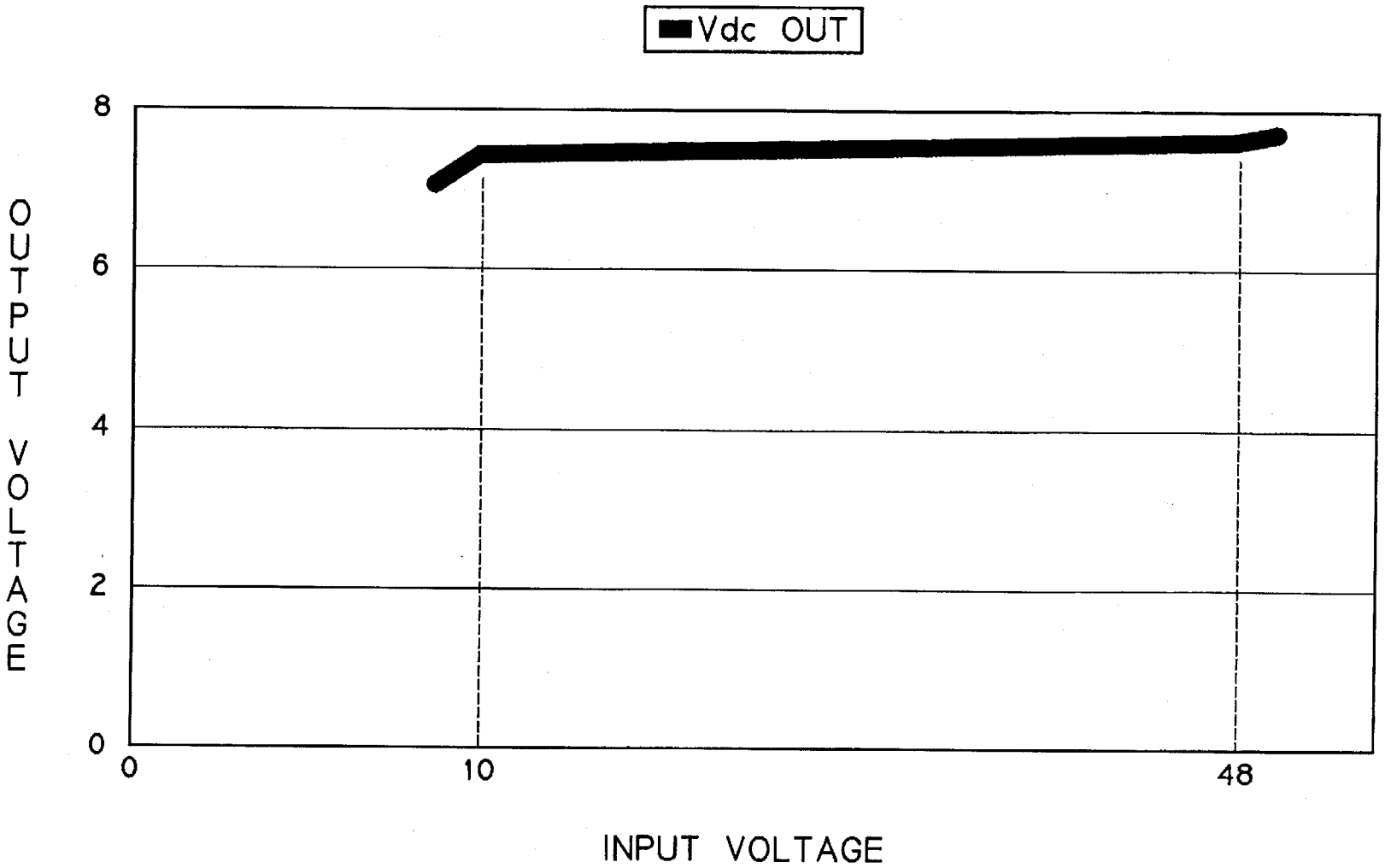
FIG. 2 shows a voltage regulator output over a range of input voltages.
Figure 3A:
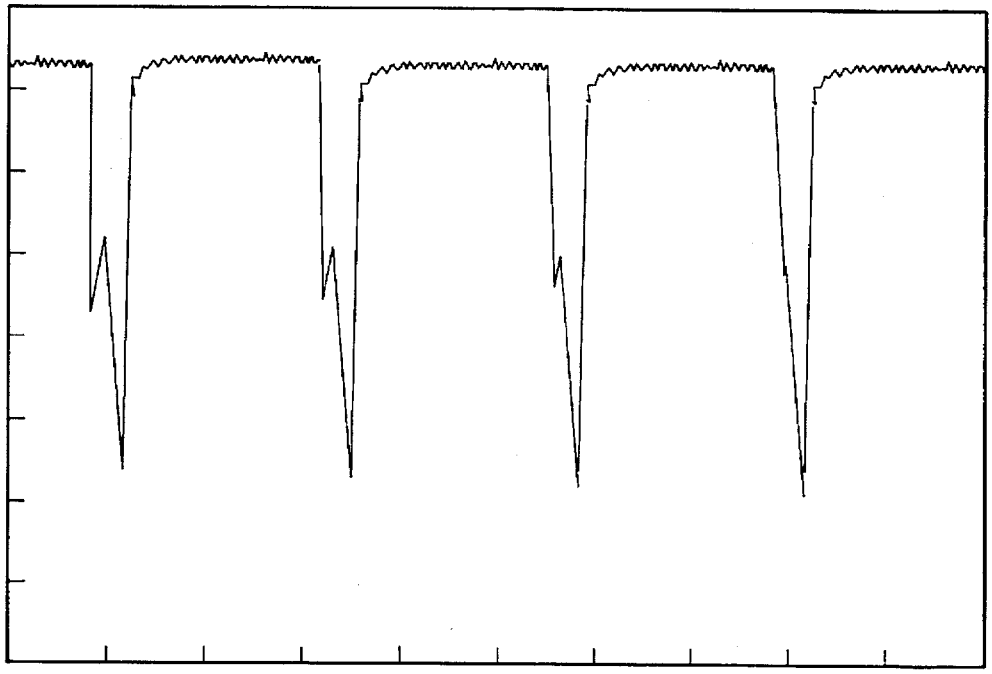
FIG. 3*a* shows the voltage regulator output as measured at test point 1 (TP1)

As can be seen in FIG. 2, the voltage regulator 12 output is substantially constant over a range of input voltages from about 10–48 volts. Commercial trucks and associated equipment such as trailer mounted refrigeration units are examples of applications that can operate over a wide range of input voltages. FIG. 3*a* shows the output of the voltage regulator 12 as measured at test point 1 (TP1). The spikes in the output of the voltage regulator 12 are caused by drive circuit 20 counter electromotive force generated when the field of transformer T1 collapses.

Figure 3B:
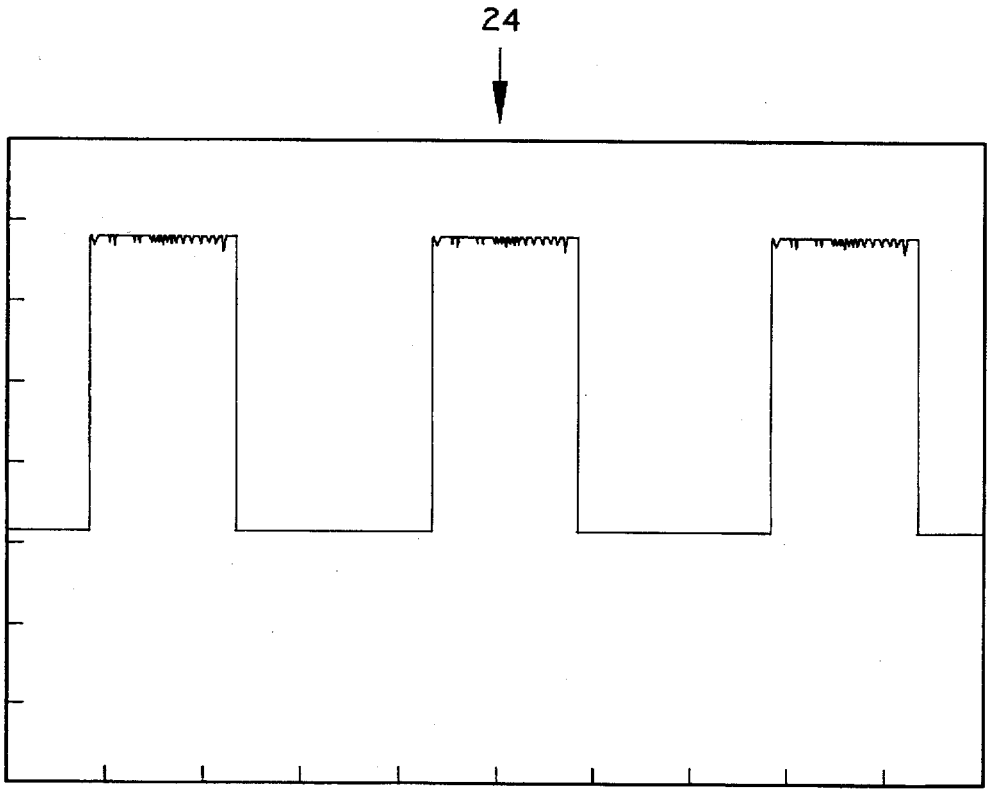
FIG. 3*b* shows a square wave oscillator sweep rate signal as measured at TP2.

Referring to FIG. 1, the square wave oscillator 14 comprises NAND gates U1-A and U1-B along with the frequency determining network of resistor R2 and capacitor C2. The NAND gates are preferably National Semiconductor quad NAND gates. The values of the frequency determining network of resistor R2 and capacitor C2 are selected to determine the frequency of the square wave oscillator 14. The values of resistor R2 and capacitor C2 as shown cause the square wave oscillator 14 to operate at approximately 2.8 Hz. FIG. 3*b* shows the output of the square wave oscillator 14 as measured at TP2. The square wave oscillator 14 produces a sweep rate signal 24 that has rising and falling edges that are typically sharper than a square wave produced by a timer. It is a feature of the invention that the square wave oscillator 14 produces a sweep rate signal 24 with near instantaneous rising and falling edges. The near instantaneous rising and falling edges of the sweep rate signal 24 are instrumental in the ramp generator 16 producing a substantially linear triangle signal.

Figure 4A:
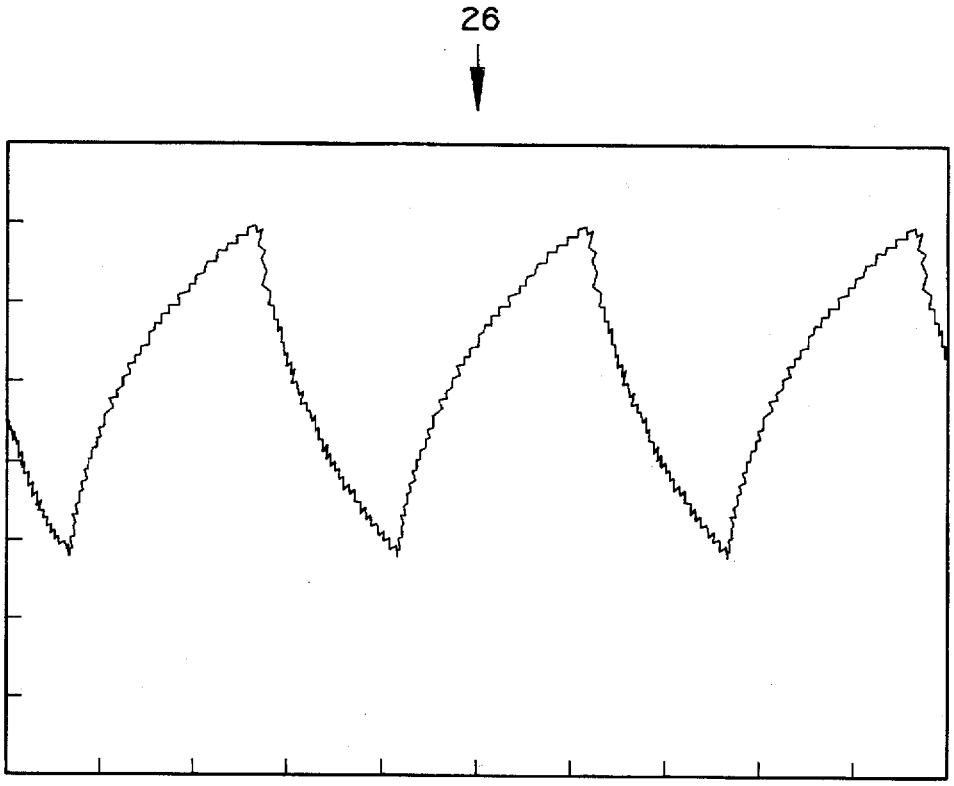
FIG. 4*a* shows a ramp generator sweep drive signal as measured at TP3.

The voltage ramp generator 16 comprises buffer U1-C and a frequency determining network formed by capacitor C3 and resistor R4. The buffer U1-C isolates the ramp generator 16 from the square wave oscillator 14. The frequency determining network of capacitor C3 and resistor R4 alter the inputted sweep rate signal 24 to create a sweep drive signal 26. The voltage ramp generator 16 receives the sweep rate signal 24 and generates the sweep drive signal 26. Referring to FIG. 4*a* that shows the output of the voltage ramp generator 16 as measured at TP3. The output of the voltage ramp generator 16 is a substantially linear sweep drive signal 26 with an amplitude of 1.87 Volts. The substantially linear sweep drive signal 26 assists in accomplishing an object of the invention to create an audio signal that has a substantially linear sweep from a rising pitch to a falling pitch and back to a rising pitch. Generally the faster the sweep rate signal 24 the more difficult it is to generate a substantially linear voltage ramp 26.

The substantially linear voltage ramp 26 can be quantified using the following formula to calculate the error compared to a true linear triangular waveform disclosed in Reference Data For Radio Engineers Fifth Edition, Howard W. Sams & Co., Inc. (1973) which is hereby incorporated by reference. The formula for the error of a triangular waveform compared to a true linear waveform is as follows $$\frac{E\Delta}{E_2} \approx \frac{T}{8RC}$$

where EΔ is error, $E_2$ is one half the amplitude of the substantially linear ramp (0.935 V), T is the period of the waveform, R is the value of resistor R4 (1.6KΩ), and C is the value of capacitor C3 (150 μF). Solving this equation for $E_\Delta$ yields $$E_\Delta \approx E_2\left(\frac{T}{8RC}\right).$$

Inserting actual values into this equation yields $$E_\Delta \approx 0.935\left(\frac{0.350S}{8(1600)(0.00015)}\right) E_\Delta \approx 0.182.$$

Therefore the substantially linear sweep drive signal 26 is a total of 18.2% different from linear.

Figure 4B:
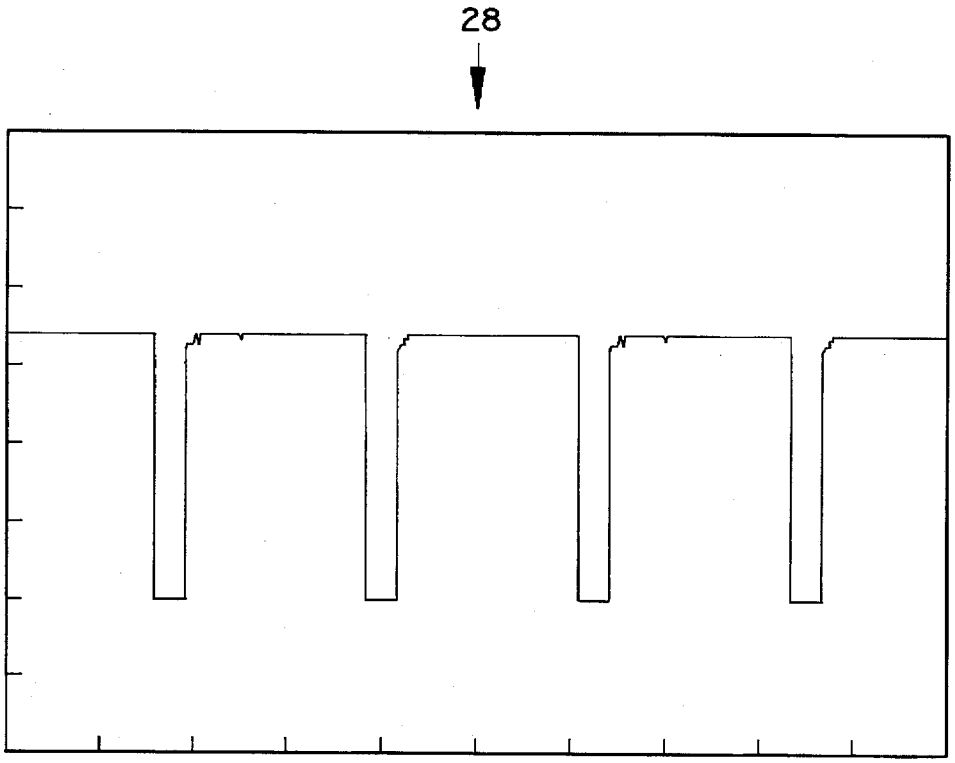
FIG. 4*b* shows a voltage controlled oscillator frequency sweep signal as measured at TP4.

The voltage controlled oscillator 18 comprises timer U2, and frequency determining network of resistors R5 and R6 and capacitor C4. The timer is preferably a 555 timer such as a Motorola MC1455BP1. Component valves of resistors R5 and R6 and capacitor C4 are selected to establish the voltage controlled oscillator's 18 center frequency of about 1,500 Hz. Component values of resistors R5 and R6 and capacitor C4 could be selected to determine a different value for the voltage controlled oscillator's 18 center frequency. The voltage controlled oscillator 18 receives the sweep drive signal 26 and generates a frequency sweep signal 28. FIG. 4*b* shows the voltage controlled oscillator 18 frequency sweep signal 28 as measured at TP4.

Figure 5A:
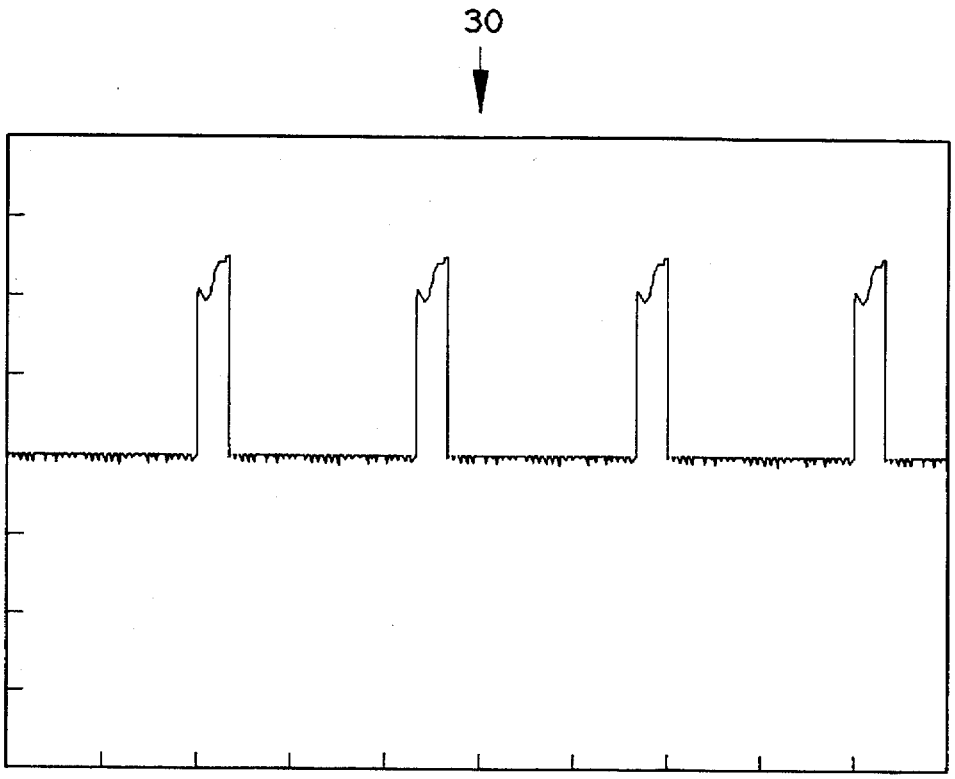
FIG. 5*a* shows a drive circuit drive input signal as measured at TP5; and, FIG. 5*b* shows a drive circuit drive output signal as measured at TP6.
Figure 5B:
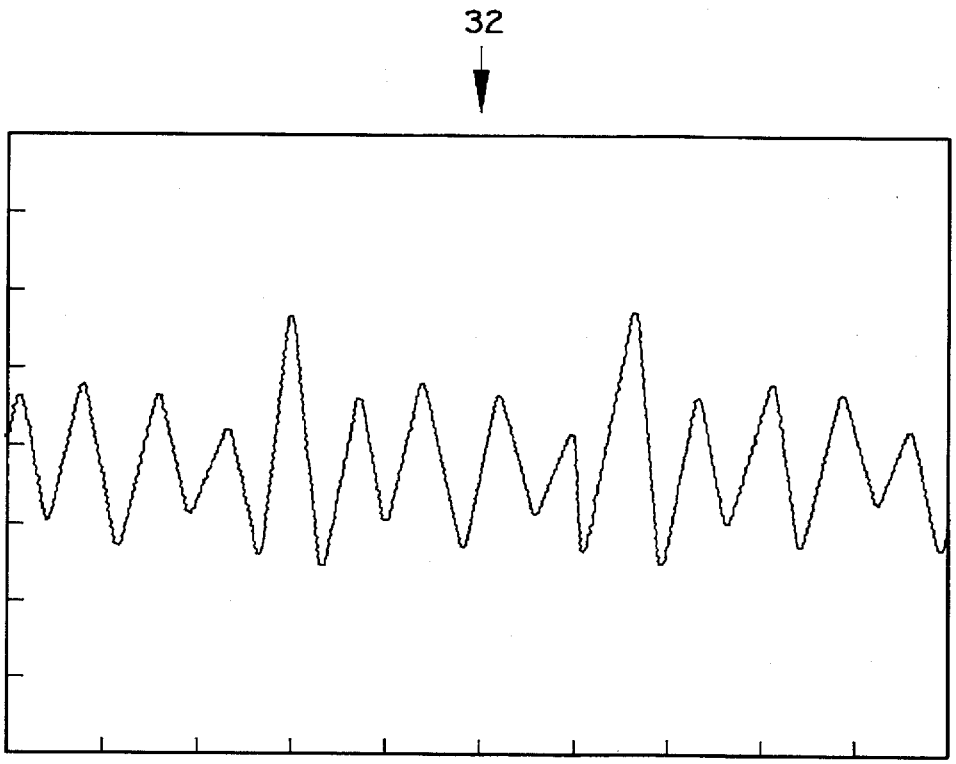

The drive circuit 20 comprises buffer U1-D, resistor R3 and transistor Q3, transformer T1 and piezoelectric transducer P1. Buffer U1-D isolates the voltage controlled oscillator 18 from the rest of the drive circuit 20. Resistor R3 limits current through the base of transistor Q3. Transistor Q3 pulses the primary coil of transformer T1 and amplifies the current through the primary coil of transformer T1. Transformer T1 steps up the voltage by a ratio of 1:7 provided to the audio circuit. The drive circuit 20 receives the frequency sweep signal 28 and generates a drive input signal 30 and a drive output signal 32. FIG. 5*a* shows the drive input signal 30 as measured at TP5, and FIG. 5*b* shows the drive output signal 32 as measured as TP6. The noise in the drive input signal 30 is caused by the counter electromotive force generated when the field of transformer T1 collapses.

The audio generator 22 is a piezoelectric transducer P1 such as available in a Sonalert® model number SC932S available from North American Capacitor Company, P.O. 1284, Indianapolis, Ind. 46206-1284. The audio output of the frequency sweeping audio signal device 10 with the disclosed piezoelectric transducer P1 is in the range from 80–90 dB. The audio generator 22 could also be a speaker. The audio generator 22 receives the drive circuit output signal 32 and generates an audio output. FIG. 5*b* shows the drive circuit output signal 32 seen by the audio generator 22. The drive circuit output signal 32 is in the form of a sine wave because of the inductance inherent in transformer T1.

OPERATION

Referring to the FIGS., the frequency sweeping audio signaling device 10 is activated when power is applied to the voltage regulator 12. The voltage regulator 12 provides a stable voltage source to the frequency sweeping audio signaling device 10. A sweep rate signal 24 is generated by the square wave oscillator 14. The sweep rate signal 24 has nearly instantaneous rising and falling edges.

The sweep rate signal 24 is provided to the ramp generator 16 that generates a sweep drive signal 26 that is a substantially linear triangular waveform. The sweep drive signal 26 is in turn provided to the voltage controlled oscillator 18 that generates a frequency sweep signal 28. The frequency sweep signal 28 is provided to the drive circuit that generates a drive input signal 30 and a drive output signal 32 that is used to drive the audio generator 22. The audio generator 22 converts the drive output signal 32 into an audio output.

What is claimed is:

1. A frequency sweeping audio signaling device, comprising:

(a) a voltage regulator for providing a stable voltage source to the frequency sweeping audio signaling device;

(b) a square wave oscillator connected to the stable voltage source that generates a sweep rate signal;

(c) a ramp generator receiving the sweep rate signal from the square wave oscillator and generating a sweep drive signal that is a substantially linear triangular waveform;

(d) a voltage controlled oscillator receiving the sweep drive signal from the ramp generator to generate a frequency sweep signal that makes an excursion rising in frequency and then falling in frequency in a substantially linear sweep;

(e) a drive circuit receiving the frequency sweep signal and generating an output frequency sweep signal that has a higher amplitude than the frequency sweep signal;

(f) an audio generator receiving the output frequency sweep signal and generating an audio frequency sweep signal that sweeps from a lower frequency to a higher frequency and back to a lower frequency in a substantially linear function; and (g) a logic gate buffer placed between the square wave oscillator and the ramp generator to reduce distortion of the square drive signal.

2. The invention as in claim 1 wherein the substantially linear triangular waveform deviates a total of no more than 20% from being linear.

3. The invention as in claim 1 wherein the square wave oscillator comprises logic gates configured with a frequency determining network.

4. The invention as in claim 3 wherein the square wave oscillator produces near instantaneous rising and falling edges of a square wave.

5. The invention as in claim 4 wherein the square wave's frequency is about 2.8 Hz.

6. The invention as in claim 1 wherein the higher frequency and the lower frequency are substantially constant frequencies.

7. The invention as in claim 1 wherein the voltage regulator provides a stable voltage source over a voltage source range of 10–48 VDC.

8. The invention as in claim 7 wherein the voltage regulator uses a Darlington pair of transistors for greater stability.

9. The invention as in claim 1 wherein the audio frequency sweep signal sweeps from approximately 1,000 Hz to approximately 2,000 Hz.

10. A method for generating a frequency sweeping audio signal, comprising the steps of:

(a) providing a stable voltage source with a voltage regulator;

(b) generating a sweep rate signal with a square wave oscillator connected to the stable voltage source;

(c) generating a sweep drive signal that is a substantially linear triangular waveform with a ramp generator that receives the sweep rate signal from the square wave oscillator;

(d) generating a frequency sweep signal with a voltage controlled oscillator that receives the sweep drive signal from the ramp generator to generate the frequency sweep signal that makes an excursion rising in frequency and then falling in frequency in a substantially linear sweep;

(e) driving the frequency sweeping signal with a drive circuit to produce an output frequency sweeping signal that has a higher amplitude than the frequency sweeping signal;

(f) generating a rising and falling audio tone that sweeps from a lower frequency to a higher frequency and back to a lower frequency in a substantially linear function by driving an audio generator with the output frequency sweeping signal; and (g) reducing distortion of the square drive signal by buffering the signal through a logic gate between the square wave oscillator and the ramp generator.

11. The method as in claim 10 wherein the substantially linear triangular waveform deviates a total of about 20% from being linear.

12. The method as in claim 10 wherein the square wave oscillator comprises logic gates configured with a frequency determining network.

13. The method as in claim 12 wherein the square wave oscillator produces near instantaneous rising and falling edges of a square wave.

* * * * *